US006134872A

United States Patent [19]

Olbrich

[11] Patent Number: 6,134,872

[45] Date of Patent: Oct. 24, 2000

[54] METHOD OF AND APPARATUS FOR PRODUCING A COMPACTED YARN

[75] Inventor: Andreas Olbrich, Kirchheim, Germany

[73] Assignee: Zinser Textilmaschinen GmbH, Ebersbach/Fils, Germany

[21] Appl. No.: 09/452,698

[22] Filed: Dec. 2, 1999

[30] Foreign Application Priority Data

Dec. 4, 1998 [DE] Germany ..... 198 56 121

[51] Int. Cl.[7] ..... D01H 7/46

[52] U.S. Cl. ..... 57/264; 57/315; 57/328; 57/333

[58] Field of Search ..... 19/150, 236–250, 19/252, 263, 286, 287, 288, 304–308; 57/264, 265, 304, 308, 315, 328, 333

[56] References Cited

U.S. PATENT DOCUMENTS

| | | | |
|---|---|---|---|
| 3,090,081 | 5/1963 | Klein . | |
| 3,122,794 | 3/1964 | Klein . | |
| 3,131,438 | 5/1964 | Klein . | |
| 4,953,349 | 9/1990 | Fehrer | 57/315 |
| 5,090,192 | 2/1992 | Stahlecker | 57/328 |
| 5,175,991 | 1/1993 | Stahlecker | 57/328 |
| 5,228,281 | 7/1993 | Stahlecker | 57/328 |
| 5,243,813 | 9/1993 | Stahlecker | 57/328 |
| 5,600,872 | 2/1997 | Artzt et al. | 19/244 |

FOREIGN PATENT DOCUMENTS

| | | |
|---|---|---|
| 0 268 217 | 5/1988 | European Pat. Off. . |
| 882 066 | 7/1953 | Germany . |
| 33 42 481 | 11/1983 | Germany . |
| 36 01 358 | 7/1987 | Germany . |
| 39 27 936 | 4/1990 | Germany . |
| 43 23 472 | 1/1995 | Germany . |

*Primary Examiner*—Michael A. Neas
*Assistant Examiner*—Gary L. Welch
*Attorney, Agent, or Firm*—Herbert Dubno

[57] ABSTRACT

A compacted yarn is produced by providing a row of orifices subsequent to drafting along which the fiber strand is guided and after which the fiber strand is subjected to a twist according to the invention the suction air flow is monitored at least at one suction location and upon falling below a threshold, a signal is generated which can be used for shutdown or to alert personnel. The result is elimination of the reduction in yarn quality which can occur when the compaction system becomes blocked by lint, fiber accumulation or the like.

15 Claims, 4 Drawing Sheets

METHOD OF AND APPARATUS FOR PRODUCING A COMPACTED YARN

FIELD OF THE INVENTION

My present invention relates to a method of and to an apparatus for producing compacted yarn by the drafting of a fiber strand, e.g. sliver, utilizing compaction by suction applied to the fiber ribbon resulting from drafting of the fiber strand through a perforation such as a row of orifices in a surface against which the fiber strand is guided. The fiber strand is twisted following the compaction and in the compacted state.

BACKGROUND OF THE INVENTION

In the production of compacted yarn, the compaction can be effected by the application of suction, e.g. to a row of orifices which can be juxtaposed with the fiber ribbon. In these systems, spun fibers and in rare cases accumulations of the spun fibers can be drawn off the yarn by suction and the suction duct, passages for other parts of the suction body can be completely or partially blocked. The suction can partly or completely fail at the perforation at which the fibers of the strands are drawn together for compaction so that yarn quality can be detrimentally affected.

Mention may be made, apart from these publications, of German patent 882 066 which discloses a drafting frame and which uses a monitoring of the feeding of short fibers between the roll pairs of a drafting frame. In this system there is no teaching of compaction. EP 0 268 217 describes a method of producing a sieve body for a friction spinning device as well as a friction spinning process. This document discloses hole cross sections which are sufficiently small to prevent penetration of fibers and which are intended to counteract the danger of stopping up. The reference does not deal with compaction systems in the sense of the invention. DE 33 42 481 describes an open-end friction spinning process and DE 36 01 358 A1 deals with an improvement thereon in the friction-spinning field.

OBJECTS OF THE INVENTION

It is the principal object of the present invention to provide an improved method of producing a compacted yarn whereby drawbacks such as the detrimental effect of blockages on yarn quality can be avoided.

Another object of this invention is to provide a method of and an apparatus for producing a compact yarn whereby drawbacks of earlier systems are precluded.

It is yet another object of this invention to provide a method of and an apparatus for maintaining yarn quality and the full effectiveness of the apparatus for producing the compacted yarn by contrast with earlier systems.

SUMMARY OF THE INVENTION

These objects are attained, in accordance with the invention by monitoring directly or indirectly the suction air flow in the suction air line between the perforation in the compacting surface and the suction source and providing an indication when there is significant deviation from a setpoint value of a monitoring parameter of the suction air stream which can be used to trigger a shutdown signal for a defect signal alerting personnel to the development of a potential failure in the compacting device.

More particularly, the method of the invention can comprise the steps of:

(a) drafting a fiber strand to produce a fiber ribbon;

(b) compacting the fiber ribbon by contacting the fiber ribbon with a surface formed with a perforation and applying suction to the perforation by evacuating a suction air stream through the perforation to form a transversely compacted strand of fibers;

(c) thereafter imparting a twist to the compacted strand;

(d) monitoring the suction air stream at at least one location;

(e) generating an indication of a monitored parameter of the suction air stream falling below a threshold value; and (f) outputting a signal in response to the indication.

In its apparatus aspects, the invention can comprise:

a drafting frame for drafting a fiber strand to produce a fiber ribbon;

means along a path of the fiber strand in the drafting frame and including a surface formed with a perforation to which suction can be applied for compacting the fiber ribbon;

a suction device connected to the perforation for evacuating a suction or stream through the perforation to form from the fiber ribbon a transversely compacted strand of fibers;

means for imparting a twist to the compacted strand;

means for monitoring the suction air stream at at least one location for generating an indication of a monitored parameter of the suction air stream falling below a threshold value; and means for outputting a signal in response to the indication.

The monitoring can be carried out at each suction station or location or at one suction location which can be branched to two or more suction locations or sets of orifices. The air throughput or volume rate of flow can be measured directly or via its relationship to the suction pressure and in the case that pressure is measured, the measured pressure can be the overall pressure, the static pressure or the dynamic pressure.

The monitoring can be effected with conventional measurement techniques suitable for use in the fluid flow field, e.g. by measurement of pressure directly using pressure sensors, or through the use of flow velocity measuring devices such as anemometers or similar sensors. The measuring system can be responsive to overstepping or understepping a fixed or adjustable threshold or by an excess deviation from a setpoint value or a measured pressure at another location detected concurrently or form an instantaneous prevailing value somewhere in the system.

The indication which produces the signal can serve to detect blockages of the type described as well as other defects in the operation and hence failures of the compressor, the duct work or the like such as loss of seal in the duct work, a decrease in the efficiency of the suction blower or the like. From a cost basis it may be advantageous to measure the suction pressure only at the suction element which is furthest from the suction blower.

The comparator of the apparatus, which compares the measured parameter with the setpoint value or threshold, can be connected to an evaluating circuit which can trigger an alarm and/or a device for shutdown of the system or an indicator or display.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
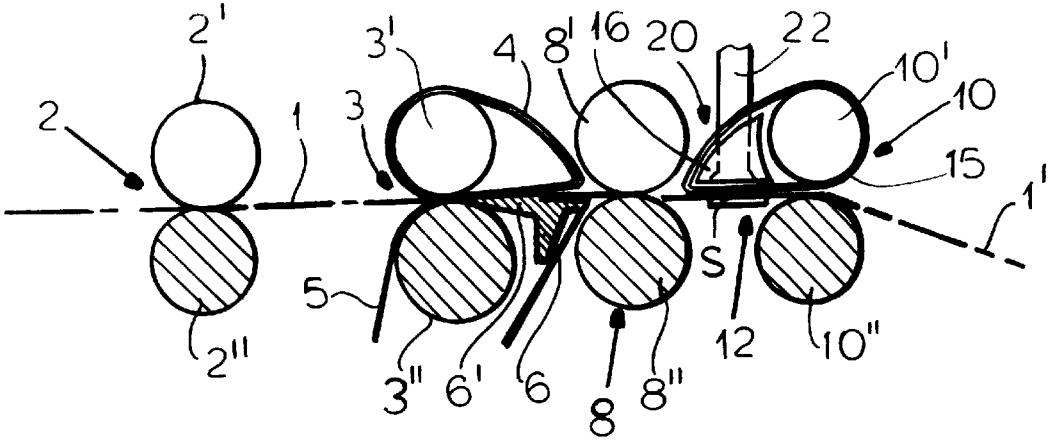
FIG. 1 is a schematic side elevational view, partly broken away, showing a drafting frame as part of an apparatus for producing compacted yarn in accordance with the invention and utilizing a fixed suction element.

The apparatus shown in FIG. 1 is intended for the reduction of a compact yarn from a fiber strand 1, e.g. a sliver drawn from the usual sliver cans and subjected to a drafting operation in the drafting frame formed by the apparatus shown in FIG. 1.

This apparatus can comprise, for example, a first roller pair 2 and a second roller pair 3 spaced from the first roller pair 1 along the path of the fiber strand 1 and defining between the roller pairs 2 and 3, a predrafting zone in which tension is applied to the strand and the fiber bundle or skein formed thereby is pulled out and the fibers straightened. The roller pair 3 is operated with a peripheral speed greater than the peripheral speed of the roller pair 2.

The roller pair 3 can be equipped with belts 4 and 5. The upper belt 4 can engage around a so-called belt cage (not shown) which can be of a conventional design, while the lower belt 5 can be of a conventional design, while the lower belt 5 can pass around a deflection rail 6 which has a flange 5' extending generally in the direction of travel of the fiber strand 1 and supporting the latter against a stretch of the belt 4. Thus the rail 6 serves simultaneously to brace the fiber strand against the upper belt 4.

Downstream of the roller pair 3 an output roller pair 8 is provided and the fiber strand is guided directly into the nip between the rollers and roller pair 8. The main drafting of the fibers is effected between the roller pair 8 and the roller pair 3 and hence the peripheral speed of the roller pair 8 is in excess of that of the roller pair 3.

The upper rollers 2', 3' and 8' of the roller pairs 2, 3 and 8 may be mounted in a weighting lever which can be raised and lowered to thread the fiber strand 1 through the drafting frame. The lower rollers 2", 3" and 8" may be continuous rollers extending below a plurality of such arms to support a number of such strands at a number of stations at which respective yarns are to be compacted.

Downstream of the output roller pair 8, a fiber bundling zone is provided at which the fully-stretched fiber strand is subjected to a transverse condensation or bundling, i.e. to a drawing together of the fibers of the strand toward the center thereof.

The fiber bundling zone 20 is provided with a suction device 12 with a perforated belt 15 guided around an upper roller 10' of a feed roller pair 10. The perforations in the belt 15 comprise a row of small orifices disposed adjacent one another and/or one behind another, extending in a row in the travel direction of the sliver.

The perforated belt 15 passes around a belt cage 16 which is connected by a suction line 22 to a suction generating-device such as one of the blowers described in connection with FIGS. 2–6. Via the suction unit 12 a suction air flow S is generated which serves to compact the fibers of the strand toward the center thereof. After leaving the feed roller pair 10, the compacted yarn 1' can have a twist imparted to it, e.g. in a ring-spinning unit. The upper roller 10' may be mounted on the aforementioned arm so that it can be weighted against the lower roller 10" or raised and lowered relative thereto. The lower roller 10" can be an elongated roller extending the full length of the drafting frame like the rollers 2", 3" and 8" previously described.

Figure 9:
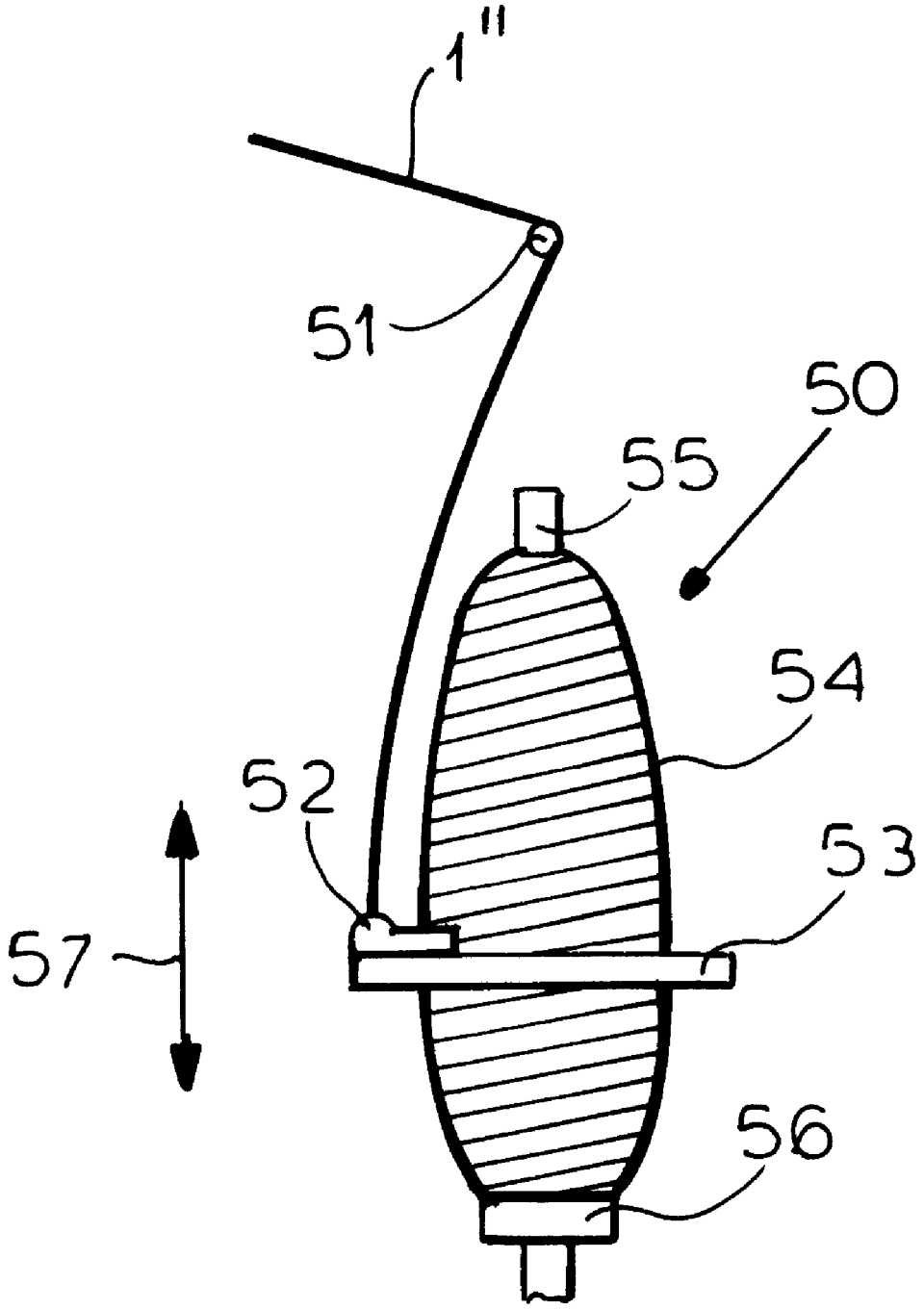
FIG. 9 is a diagrammatic elevational view illustrating the twisting unit which can be used in the embodiments of FIGS. 1–6.

The compacted strand 1", as noted, can be fed to a ring-spinning system of the type shown in FIG. 9 and after passing through a thread guide eye 51 of the ring-spinning station 50, can pass around a traveler 52 orbiting a ring 53 surrounding the bobbin 54 which is wound on a core sleeve 55 of a spindle 56 in accordance with the usual principles of ring-spinning operation. The ring 53 maybe raised and lowered on a conventional ring rail as represented by the arrow 57. The twist for the embodiment of FIGS. 2–6 maybe imparted by a similar unit 50.

Figure 3:
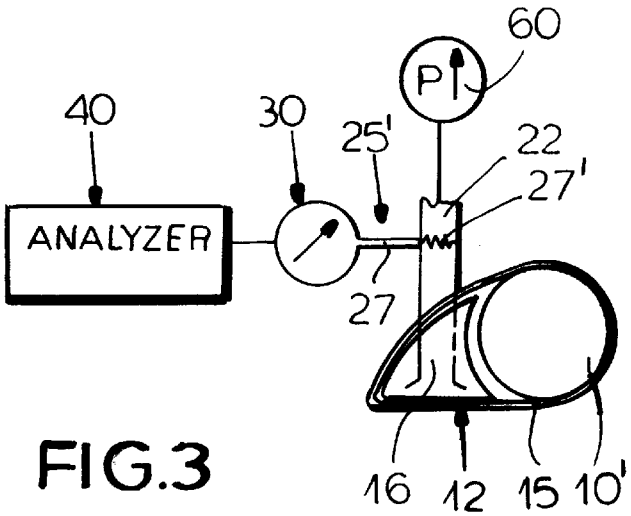
FIGS. 2 and 3 are similar views of devices for monitoring suction air streams which can be used in the apparatus of FIG. 1, where moving surfaces provide the perforation.
Figure 2:
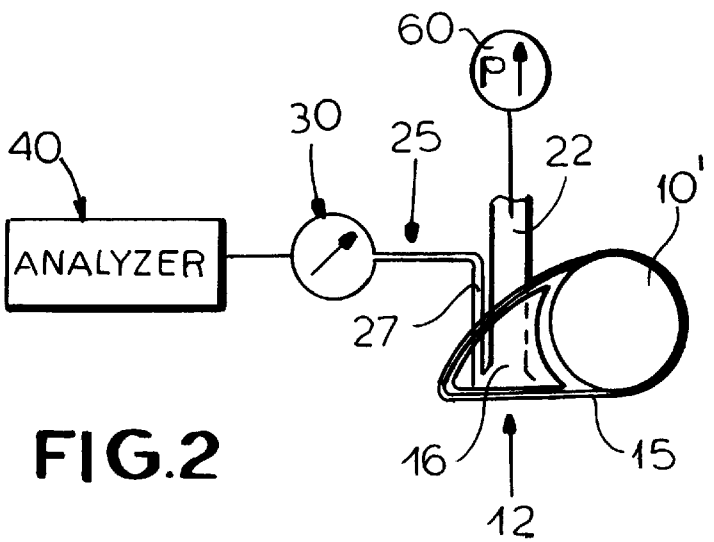

The suction device 12 is provided, in accordance with the invention with a device 25 or 25' (FIGS. 2 and 3) for detecting a parameter of the suction air stream S. The suction is here generated at the suction side of a suction blower 60. The device 25 includes a comparator 30 which compares the pressure of the suction device 12 as measured across a tube 27 in the flow of air with a setpoint value of the pressure and supplies a signal to an analyzer 40. The measuring tube 27 may operate in accordance with Pitot tube principles and detects the flow S directly in the housing of the cage 16 which is part of the suction device 12. In the embodiment of FIG. 3 the air flow is measured by a hot wire anemometer represented at 27' and the signal is communicated via tube 27 to the comparator 30. The suction line in the embodiments of FIGS. 1–6 in each case has been represented at 22.

The analyzer 40 is shown only schematically and can generate an alarm to alert personnel and/or be provided for automatic shutdown of the system or as a display device.

The device 25 or 25' in each case measures the suction generated and should that suction fall below a threshold provided by the comparator 30, will output an error and/or shutdown signal to which the analyzer 40 responds. The threshold can be adjustable and can be matched to the quality of the yarn desired. The measuring tube 27 and the measuring system described respond to total pressure, static pressure and/or dynamic pressure or the flow velocity of the air.

Figure 7:
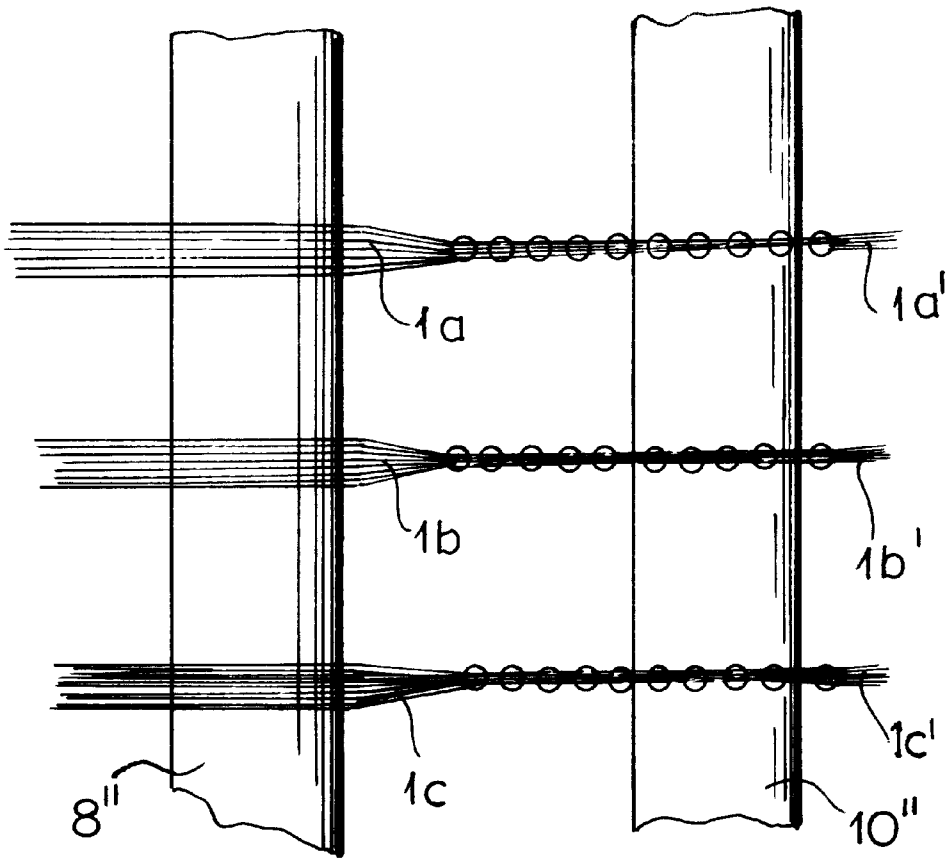
FIG. 7 is a diagram illustrating the invention in which the perforation for each fiber strand or ribbon to be compacted is shown as a row of perforations, that row of perforations being stationary as in FIG. 1 or movable as is the case with FIGS. 2–6.

In FIG. 7 a row of the orifices through which suction is generated is shown diagrammatically as compacting the slivers 1*a*, 1*b*, 1*c* to compact yarn 1*a'*, 1*b'*, 1*c'* prior to imparting of a twist thereto.

Figure 4:
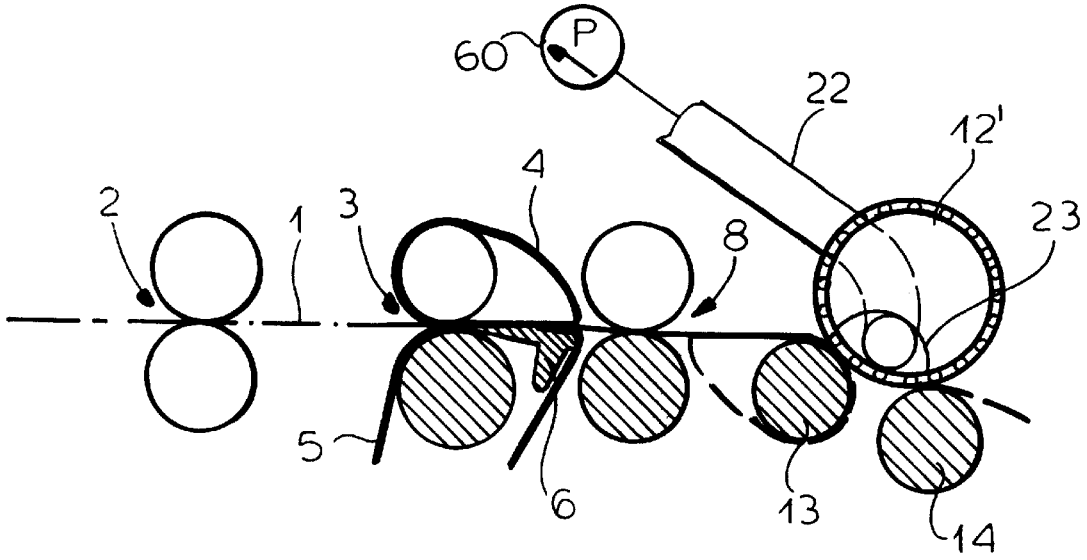
FIG. 4 is a view similar to FIG. 1 utilizing a perforated suction drum.
Figure 5:
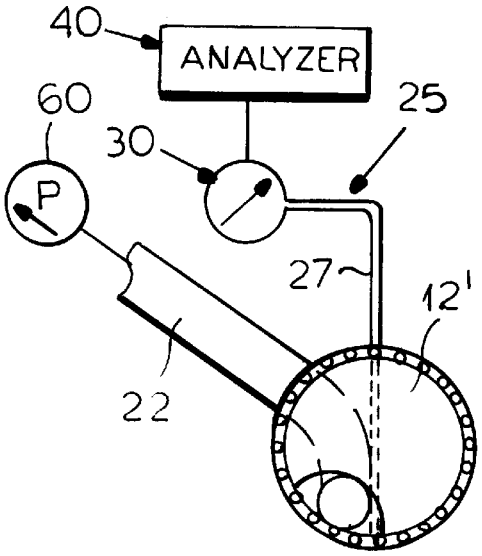
FIGS. 5 and 6 are cross sectional views from the sides showing other perforated drum systems and different modes of monitoring suction air streams.
Figure 6:
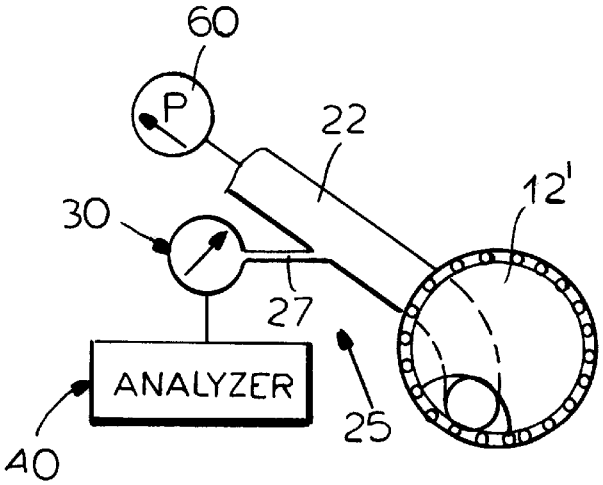
Figure 8:
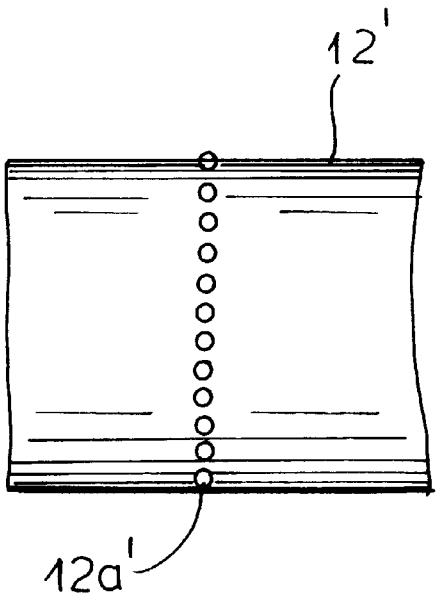
FIG. 8 is an elevational view showing one of the drums and the row of perforations thereon.

The embodiments shown in FIGS. 4–6 utilize as compacting elements, drums 12' which, as can be seen from FIG. 8, can have a row of orifices 12*a'* formed therein. The drum 12' is thus a perforated suction drum which rotates against the fiber strand 1 and can be juxtaposed with two counter-rollers 13 and 14 to compact the yarn. The drafting frame may be, except for the difference in the compacting stage, the same as that of FIG. 1.

The suction is applied via pipe 22 to a hood 23 spanning the region within the drum 12' encompassing the segment of the orifice row directly in contact with the fiber strands. By analogy to the embodiments of FIGS. 2 and 3, FIGS. 5 and 6 show that the measurement tube 27 can open directly into the suction element within the drum (FIG. 5) or into the tube 22, possibly utilizing in the latter case a heated wire anemometer as has been described.

In the embodiments of FIGS. 4, 5 or 4, 6, therefore, the suction air stream is also monitored and upon a fall in the suction below the threshold, a signal is generated which can alert personnel and/or shut down the unit and/or be displayed to minimize the reduction in yarn quality. The threshold is adjustable in these embodiments as well and at each suction location, the total pressure, the static pressure or dynamic pressure can be measured.

I claim:

1. A method of making a compacted yarn comprising the steps of:

(a) drafting a fiber strand to produce a fiber ribbon;

(b) compacting said fiber ribbon by contacting said fiber ribbon with a surface formed with a perforation and applying suction to said perforation by evacuating a suction air stream through said perforation to form a transversely compacted strand of fibers;

(c) thereafter imparting a twist to said compacted strand;

(d) monitoring said suction air stream at at least one location;

(e) generating an indication of a monitored parameter of said suction air stream falling below a threshold value; and (f) outputting a signal in response to said indication.

2. The method defined in claim 1, further comprising shutting down the making of the compacted yarn with said signal.

3. The method defined in claim 1, further comprising alerting an operator with said signal.

4. The method defined in claim 1 wherein the monitoring of said suction air stream is effected at a location in a path between a suction side of a compressor and said perforation and said indication is generated upon an excessive deviation from a setpoint value.

5. The method defined in claim 1 wherein a suction air stream is generated at a plurality of suction locations and the suction air stream is monitored as to volume rate of flow at each of said locations.

6. The method defined in claim 1 wherein said threshold is adjustable.

7. The method defined in claim 1 wherein said parameter is selected from the group which consists of the static pressure, the dynamic pressure and the air-flow velocity.

8. An apparatus for making a compacted yarn comprising:

a drafting frame for drafting a fiber strand to produce a fiber ribbon;

means along a path of said fiber strand in said drafting frame and including a surface formed with a perforation to which suction can be applied for compacting said fiber ribbon;

a suction device connected to said perforation for evacuating a suction air stream through said perforation to form from said fiber ribbon a transversely compacted strand of fibers;

means for imparting a twist to said compacted strand;

means for monitoring said suction air stream at at least one location for generating an indication of a monitored parameter of said suction air stream falling below a threshold value; and means for outputting a signal in response to said indication.

9. The apparatus defined in claim 8 wherein said means for monitoring said suction air stream includes a comparator for comparing the measured parameter with a setpoint value of the measured parameter.

10. The apparatus defined in claim 8 wherein a respective means for monitoring the suction air stream is provided in each path between a respective suction source and a respective perforation for a respective strand.

11. The apparatus defined in claim 8 wherein an evaluating unit is provided to receive said signal, said evaluating unit generating an alarm.

12. The apparatus defined in claim 8, further comprising an evaluating unit receiving said signal and adapted to shut down said apparatus.

13. The apparatus defined in claim 8, further comprising an evaluating unit receiving said signal and formed with a display for said signal.

14. The apparatus defined in claim 8 wherein said surface is formed by an endless belt and said perforation is a row of orifices in said belt.

15. The apparatus defined in claim 8 wherein said surface is formed by a drum having a row of perforations.

* * * * *